US005424155A

United States Patent [19]

Nakayama et al.

[11] Patent Number: 5,424,155

[45] Date of Patent: Jun. 13, 1995

[54] ELECTROPHOTOGRAPHIC LITHOGRAPHIC PRINTING PLATE PRECURSOR

[75] Inventors: Takao Nakayama; Shigeyuki Dan; Hidefumi Sera, all of Shizuoka, Japan

[73] Assignee: Fuji Photo Film Co., Ltd., Kanagawa, Japan

[21] Appl. No.: 983,517

[22] PCT Filed: Jun. 26, 1992

[86] PCT No.: PCT/JP92/00815

§ 371 Date: Apr. 21, 1993

§ 102(e) Date: Apr. 21, 1993

[87] PCT Pub. No.: WO93/00615

PCT Pub. Date: Jan. 7, 1993

[30] Foreign Application Priority Data

Jun. 28, 1991 [JP] Japan ..... 3-158474

[51] Int. Cl.[6] ..... G03G 13/28

[52] U.S. Cl. ..... 430/49

[58] Field of Search ..... 430/14, 18, 49, 66

[56] References Cited

U.S. PATENT DOCUMENTS

| | | | |
|---|---|---|---|
| 3,658,538 | 4/1972 | Hilhorst | 430/14 |
| 4,272,569 | 6/1981 | Shaw et al. | 430/18 |
| 4,400,440 | 8/1983 | Shaw | 430/69 |

*Primary Examiner*—John Goodrow

*Attorney, Agent, or Firm*—McAulay Fisher Nissen Goldberg & Kiel

[57] ABSTRACT

The present invention aims at, in an electrophotographic lithographic printing plate precursor, improving the construction and composition of back layers and in particular, preventing occurrence of printing scum by rubbing and increasing the number of prints until printing wrinkles occur. The feature of the present invention consists in an electrophotographic lithographic printing plate precursor comprising, at least, a photoconductive layer on one surface of a base and a back layer on the other surface thereof, in which the back layer comprises an outermost layer containing a hydrophilic high molecular material and an innerlayer having a Cobb's water absorbing capacity of at most 25 $g/m^2$ (45 minute value).

11 Claims, 2 Drawing Sheets

ELECTROPHOTOGRAPHIC LITHOGRAPHIC PRINTING PLATE PRECURSOR

FIELD OF THE INVENTION

This invention relates to an electrophotographic lithographic printing plate precursor and more particularly, it is concerned with an electrophotographic lithographic printing plate precursor excellent in printing adaptability as well as printing efficiency and capable of giving a high image quality print.

BACKGROUND TECHNIQUE

Up to the present time, there has generally been employed an electrophotographic process for the production of a lithographic printing plate precursor comprising subjecting the photoconductive layer of an electrophotographic lithographic printing plate precursor to uniform static charge, to imagewise exposure and then to liquid development with a liquid toner to obtain a toner image, then fixing this toner image and processing with an oil-desensitizing solution (etching solution) to render hydrophilic a non-image area free from the toner image.

As a base for the lithographic printing plate precursor, a paper which has previously been rendered electroconductive, etc. is used, but this paper base is penetrated with water, resulting in bad influences on the printing durability or photographic properties. That is, the paper base is penetrated with the above described etching solution or dampening water during printing and expanded so that the photoconductive layer sometimes separates from the paper base to lower the printing durability, sad the moisture content of the paper base is varied with the temperature and humidity conditions in carrying out the above described static charge or imagewise exposure so that the electric conductivity is varied to affect unfavorably the photographic performances. Furthermore, if the water resistance is insufficient, wrinkles occur during printing.

In order to solve these problems, it has been proposed to coat the one or both surfaces of a support with, for example, an epoxy resin or ethylene-acrylic acid copolymer having water resisting property (Japanese Patent Laid-Open Publication Nos. 138904/1975, 105580/1980 and 68753/1984) or to provide with a laminated layer of polyethylene or the like (Japanese Patent Laid-Open Publication Nos. 57994/1983).

Furthermore, a layer provided as a back coated layer on the opposite surface to a surface of a support having a photoconductive layer (also called "top layer" or "printing surface") is called a back layer, and various improvements have been made as to a composition for forming the back layer for the purpose of not only imparting water resistance thereto, but also maintaining various functions.

The inventors have developed and proposed, as a process for developing an electrophotographic lithographic printing plate precursor, a liquid development method by the so-called direct electron injection system, as disclosed in Japanese Patent Laid-Open Publication No. 26043/1989, which method comprises using a conductor instead of an electrode at the opposite side of a printing surface and effecting development while directly feeding electrons to the back side of a base from this conductor, whereby the prior art system of passing a master through a developing liquid flowed between electrodes is substituted.

As an improved technique, the inventors have further proposed a precursor comprising a base having polyolefin laminated layers on both the surfaces of the base, provided with, as a back layer, a layer having a surface electric resistance of at most $1\times10^{10}$ Ω and a larger friction resistance than the polyolefin laminated layers, whereby to render correct winding and fixing of the printing plate, to prevent slipping in printing, to carry out favorably electrophotographic printing plate making and to render possible developemnt by the direct electron injection system (Japanese Patent Laid-Open Publication No. 84665/1990).

In addition, the inventor have proposed a precursor comprising an under layer and a photoconductive layer provided on the surface of a base and a back layer on the back surface thereof, the under layer having a surface resistivity of $1\times10^{8}$ to $1\times10^{14}$ and the back layer,-having a surface resistivity of at most $1\times10^{10}$, whereby a uniform image can be formed by any develpment method of the prior art and the direct electron injection system precisely, favorably and rapidly without occurrence of pinholes as a solid image, and a development method thereof (Japanese Patent Laid-Open Publication No. 132464/1990).

Since a lithographic printing plate precursor is ordinarily wound in the form of a roll, a back layer and a printing surface (top layer) are brought into contact with each other and a composition for forming the back layer, for example, a water resistance improver is tranferred to the top layer. If the water resistance improver adheres to a toner image-free area (non-image area), there arises such a problem that stain occurs on a print (called printing scum by rubbing). When the amount of the water resistance improver in the back layer is decreased so as to prevent the rubbing stain, the water resistance (water proof property) is naturally lowered so that wrinkles occur during printing and further printing is impossible. That is, it is difficult to satisfy both the requirements, i.e. preventing the rubbing stain and maintaining the water resistance (preventing wrinkles during printing).

For the back layer is required a function to ensure printing adaptability or operativeness, such as tendency of adhering to a printing drum (fitting property) and not slipping from the printing drum in addition to the above described two functions.

Therefore, it is an object of the present invention to provide an electrophotographic lithographic printing plate precursor having a good performance for the printing scum by rubbing and tendency of less occurrence of wrinkles during printing, and being capable of satisfying the printing performances such as fitting property and tendency of hardly slipping off and printing a number of good image prints.

It is another object of the present invention to provide an electrophotographic lithographic printing plate precursor capable of being applied to both development of the ordinary electrophotographic printing plate and development of direct electron injection system and further satisfying the above described prevention of the printing scum by rubbing and printing performances.

DISCLOSURE OF THE INVENTION

As a means for solving the above described problems, the present invention provides an electrophotographic lithographic printing plate precursor comprising, at least, a photoconductive layer on one surface of a base and a back layer on the other surface thereof, in which the back layer comprises an outermost layer containing a hydrophilic high molecular material and an inner layer having a Cobb's water absorbing capacity of at most 25 g/m$^2$ (45 minute value).

BEST EMBODIMENT OF THE PRESENT INVENTION

The feature of the present invention consists in that a back layer is composed of a plurality of layers comprising an outermost layer (farthest from a base) and an inner layer (nearest to a base), sharing functions with one another, whereby both the water resistance and hydrophilicity can be simultaneously satisfied, which has hitherto been considered difficult. That is, the back layer of the present invention comprises an outermost layer (which will hereinafter be referred to as Layer A) containing a hydrophilic high molecular material and an inner layer (which will hereinafter be referred to as Layer B) having a Cobb's water absorbing capacity of at most 25 g/m$^2$ (45 minute value).

By Cobb's method is meant a method of examining the water absorbing capacity in the case of contacting one side of a non-absorbing paper or plate paper with water for a certain time according to JIS P-8140 "Test Method of Water Absorbing Capacity of Paper and Plate Paper". In the present invention, the contact time is 45 minutest. The water absorbing capacity according to this method is not directly related with the water repellent property of a paper.

In the presnt invention, Layer A as the outermost layer contains a hydrophilic high molecular material and accordingly, when the surface of the back layer is contacted with the top layer in rolled state, the layer transferred to the top layer is the layer containing a large amount of a hydrophilic high molecular material and occurrence of printing scum by rubbing can be prevented. For the purpose of further increasing the ability of preventing such rubbing, hydrophilic colloidal grains, etc. can be added.

Moreover, a sufficient water resistance and water proofing property can be maintained to prevent occurrence of printing wrinkles by providing Layer B of the back layer of the present invention with a layer having a low water absorbing capacity. The principal object of Layer A is to prevent occurrence of printing scum by rubbing and Layer B is capable of maintaining properties required as a printing plate. Layer B is composed of a single layer, but as o occasion demands, Layer B can be composed of a plurality of layers.

For the purpose of improving the bonding strength between Layers A and B, hydrophilic high molecular materials, for example, organo titanium compounds, silane coupling agents ($(RO)_3$—Si—X), titanate coupling agents and the like can be added to one or both of these layers.

According to the present invention, as illustrated above, opposite functions of preventing printing scum by rubbing and water proofing property can simultaneously be satisfied with compatibility.

Layer A of the present invention is a layer containing a hydrophilic high molecular material.

Figure 1:
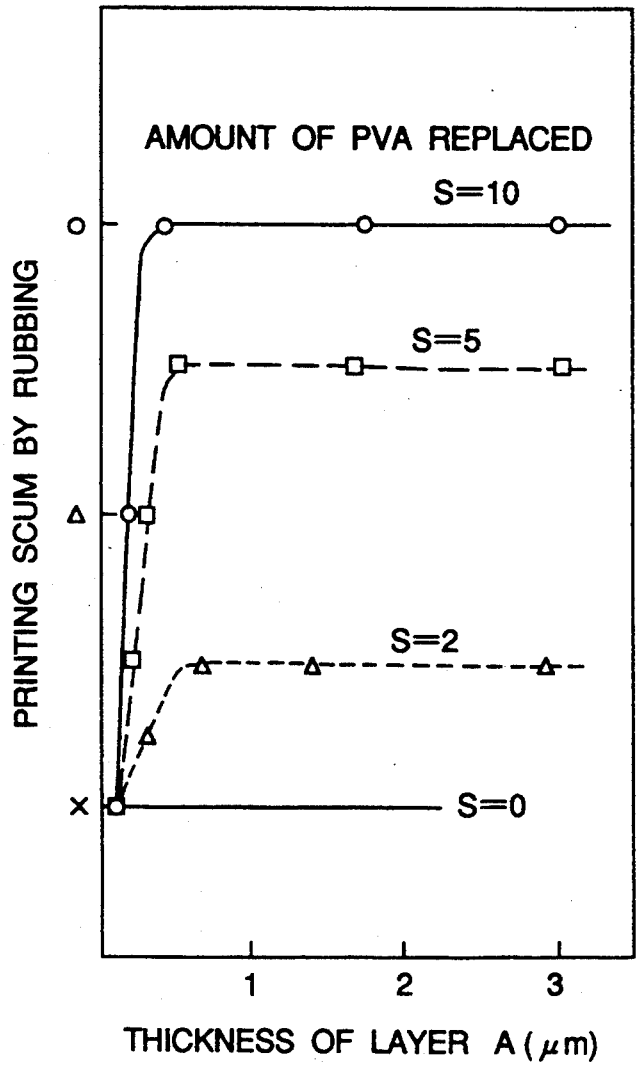
FIG. 1 is a graph showing the relationship between the thickness of an outermost layer (Layer A) of a back layer of the present invention and the occurrence of printing scum by rubbing.

In FIG. 1 are shown experimental results to examine the occurrence of printing scum obtained by forming Layer B of the present invention on a base and forming Layer A of a composition (containing no hydrophilic high molecular material) of Recipe (A-2) in hereinafter described Comparative Example 1 or a composition of such a recipe that 43% by weight of polyacrylic acid ester in Recipe (A-2) is partly replaced by polyvinyl alcohol (referred to as PVA) as a hydrophilic high molecular material in a proportion of 2%, 5% and 10%, while varying the thickness of Layer A, to obtain samples, then forming a photoconductive layer with a common composition on each of these samples and subjecting the resulting electrophotographic printing plate precursors to printing.

FIG. 1, marks have the following meanings:

○: no occurrence

Δ: slight occurrence

X: occurrence

As is evident from FIG. 1, occurrence of the printing scum by rubbing is lowered with increase of the amount of PVA replaced, and Even if the thickness of Layer A is considerably small, the layer is effective, but if exceeding 1 μm, the effect is substantially independent upon the thickness.

As the hydrophilic high molecular material of Layer A of the present invention, there can be used any of natural or synthetic known hydrophilic high molecular materials, illustrative of which are gelatins such as ordinary lime-treated gelatins, acid-treated gelatins, modified gelatins, derivative gelatins, etc., celluloses such as albumins, sodium alginate, gum arabic, cellulose, hydroxyethyl cellulose, carboxy-methyl cellulose, etc., water-soluble derivatives such as starch, hydrophilic high molecular materials such as polyvinyl alcohol, polyvinylpyrrolidone, polyacrylamide, styrene-maleic anhydride copolymers and the like, individually or in combination. The effect of preventing printing scum by rubbing can further be improved by adding hydrophilic colloidal grains (obtained by finely divided hydrophilic materials such as silica ($SiO_2$), alumina ($Al_2O_3$), zeolites, etc. and dispersing the fine grains in stable manner in colloidal state).

Layer A of the present invention is composed of the above described hydrophilic high molecular material and another material for forming Layer A. As the material for forming Layer A, there can be used, for example, at least one of various water resisting materials, water resisting and organic solvent resisting materials, synthetic emulsions and the like.

Examples of the water-resisting material are water-resisting film-forming materials such as polyvinyl chloride, acrylic resins, polystyrene, polyethylene, alkyd resins, styrene-butadiene copolymers and ethylene-vinyl acetate copolymers and organic solvent-resisting film-forming materials such as starch, oxidized starch, PVA, methyl cellulose, hydroxyethyl cellulose and CMC.

As the water-resisting and organic solvent-resisting materials, for example, there are used ethylene-vinyl alcohol copolymers, high polymerization degree polyesters, high polymerization degree polyurethanes and the like. Furthermore, starch, PVA, acrylic resins (i.e. reactive acrylic resins in the form of organic solvent solutions or O/W type emulsions), alkyd resins (air-hardening type), etc. and crosslinking agents such as melamine resins can jointly be used as the water-resisting and organic solvent-resisting materials.

As the synthetic emulsion, there can be used those obtained by subjecting monomers or prepolymers such as acrylic acid esters, methacrylic acid esters, vinyl chloride, vinylidene chloride, vinyl acetate, polyurethanes prepolymers, acrylonitrile, butadiene, styrene-butadienes, etc. to emulsion polymerization or emulsion copolymerization.

These materials for forming Layer A can of course be used in combination. If necessary, dispersants, levelling agents, crosslinking agents, etc. can be added to Layer A.

The proportion of the above described hydrophilic high molecular material in the whole quantity of the Layer A-forming composition is preferably about 3 to 40 weight %.

Layer B of the present invention can be composed of any material capable of satisfying the condition of a water absorbing capacity of at most 25 g/m$^2$ (45 minute value) by the Cobb's method. The absorbing capacity value by the Cobb's method depends on not only the composition of a water-resisting coating agent of Layer B, but also the thickness of Layer B. In the case of a same composition, the water absorbing capacity is lowered with increase of the layer thickness.

Figure 2:
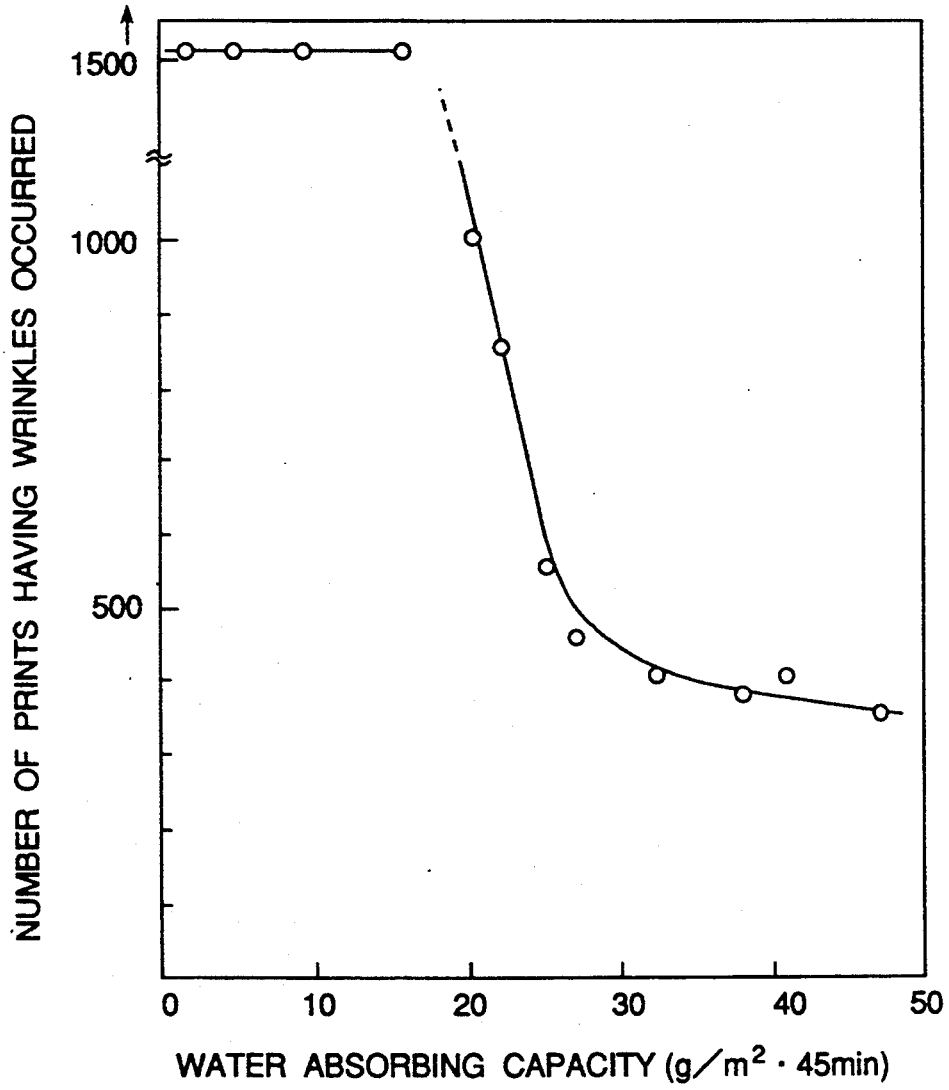
FIG. 2 is a graph showing the relationship between the water absorbing capacity of an inner layer (Layer B) of a back layer of the present invention and the number of prints until occurrence of wrinkles during printing.

In FIG. 2 is shown the relationship between the water absorbing capacity by the Cobb's method (45 minute value) of Layer B formed in a thickness of 7 μm (on dry basis) on a base and the number of wrinkles occurred (number of prints until occurrence of printing wrinkles appear after printing). In the hereinafter described Recipe (B-1), the ratio of clay/resin is varied to vary the water absorbing capacity and Layer A with a common composition having a water absorbing capacity of 85 g/m$^2$ is provided on Layer B. A photoconductive layer is formed on this base to prepare an electrophotographic printing plate precursor, which is then subjected to printing by a printing machine. As is evident from FIG. 2, the number of prints until wrinkles occur is rapidly increased at a Cobb's water absorbing capacity of at most 25 g/m$^2$.

As the material for forming Layer B, there can be used the various water-resisting materials, water-resisting and organic solvent-resisting materials and synthetic emulsions, described above as the material for forming Layer A, and moreover, water-soluble high molecular compounds can also be used.

As the water-soluble high molecular compound, there are used starch or its water-soluble derivatives, water-soluble cellulose derivatives, casein, polyvinyl alcohol, styrene-maleic anhydride copolymers, vinyl acetate-maleic anhydride copolymers, etc. In this case, the quantity of this compound is so selected that the water absorbing capacity of Layer B be at most 25 g/m$^2$ (45 minute value).

These materials for forming Layer B of course be used in combination. If necessary, dispersants, levelling agents, crosslinking agents, etc. can be added to the inner layer, as in the case of Layer A.

In addition, the adhesiveness between both Layers A and B can further be increased by adding a hydrophilic high molecular binder, for example, organo titanium compound to one or both of Layers A and B, as described above.

In the present invention, the thickness of Layer A is so adjusted that the function thereof can well be given and is not particularly limited, but it is generally in the range of about 0.5 to 10 μm. The thickness of Layer B is generally about 2 to 25 μm and when Layer B is composed of a plurality of layers, the total thickness should be in this range.

The whole thickness of the back layer including Layers A and B of the present invention is generally 8 to 25 μm, preferably 8 to 15 μm.

As the base of the present invention, any of known water absorbing base materials commonly used in the electrophotographic lithographic printing plate precursor of this kind can be used, for example, substrates such as papers, plastic sheets, those subjected to a treatment for rendering electroconductive e.g., by impregnating a low resistance material therein, those provided with a water-resisting adhesive layer or at least one precoat layer, papers laminated with plastic sheets rendered electroconductive by vapor deposition of Al and the like.

Examples of the electroconductive substrate or the material rendered electroconductive are described in Yukio Sakamoto, "Denshishashin (Electrophotography)" 14, No. 1, p 2–11 (1975), Hiroyuki Moriga, "Nyumon Tokushushi no Kagaku (Introduction to Chemistry of Special Papers)", published by Kobunshi Kankokai (1975), M. F. Hoover, "J. Macromol. Sci. Chem." A-4 (6), p 1327–1417, (1970), etc.

The photoconductive layer of the present invention contains at least a photoconductive material and binder. As the photoconductive material, any of inorganic materials and organic materials can be used.

Examples of the inorganic photoconductive material include Si, Ge, zinc oxide, cadmium sulfide, titanium oxide, selenium, cadmium selenide, zinc selenide or lead oxide, chalcogen alloys such as Se-Te alloys, $As_2S_3$, $As_2Se_3$, etc.

Examples of the organic photoconductive material include photoconductive cyanine pigments, photoconductive quinoline pigments, photoconductive phthalocyanine pigments, photoconductive pyridium salt pigments, substituted vinyloxazole, triphenylamine derivatives, anthracene, benzo condensed heterocyclic compounds, pyrazoline or imidazole derivatives, oxadiazole derivatives, vinylaromatic polymers and coplymerized products thereof, fluorenone derivatives, polyarylalkanes such as triarylmethaneleueo dyes and squarie acid derivative dyes, perylene, tetraeene, carbazole, tetrabenzyl-p-phenylenediamine, squarium, indigo, dimethylperimide, polyvinyltetraeene, polyvinylperylene, acylhydrazone derivatives, benzothiazole derivatives, tetracyanopyrene, chloroegan blue and the like. These materials can be used in combination.

As the binder, there can be used silicone resins, polystyrene, polyacrylic acid or polymethacrylic acid esters, polyvinyl acetate, polyvinyl chloride, polyvinyl butyral and derivatives thereof or other known materials as a binder for a photoconductive layer.

The photoconductive material in the photoconductive layer is generally used in such a manner that the proportion of the photoconductive material to the binder is in the range of 3:1 to 20:1 by weight, but this is not particularly limited in the present invention. If necessary, a sensitizer or a coating aid commonly used for coating and other additives can be added.

The thickness of the photoconductive layer is generally about 5 to 30 μm, but this is not particularly limited in the present invention. In order to increase the bonding strength between the photoconductive layer and under layer, it is desirable to previously subject the surface of the under layer to a surface treatment such as corona discharge, glow discharge, flame, ultraviolet ray, ozone, plasma treatments and the like, as described in U.S. Pat. No. 3,411,908.

Preparation of the lithographic printing plate precursor of the present invention can generally be carried out by a known technique in the field of producing the electrophotographic lithographic printing plate precursor of this kind.

As a means for dispersing, there can be used ordinary ball mills, colloidal mills, ultrasonic dispersing machines, three roll mills, grain mills, homogenizers, homomixers and the like. As a coating means it is preferable to use air knife coaters, trailing grade coaters, wire bar coaters, reverse roll coaters, kiss roll coaters, fountain coaters and the like.

The precursor of the present invention, as illustrated above, is converted into a lithographic printing plate through the ordinary steps of charging, imagewise exposure, development, etc. and is of course suit:able for the development of direct electron injection system.

The present invention will now be illustrated in greater detail by way of examples, but it should be understood that the present invention is not limited thereto.

EXAMPLE 1

A fine quality paper with a basis weight of 85 g/m$^2$ was used as a base and coated with a composition (B-1) prepared by the following recipe (B-1) by means of a wire bar, as an inner layer of a back layer, and dried at 140° C. for 1 minute to form an inner layer with a thickness of 7 μm. A composition (A-1) was prepared by the following recipe (A-1), similarly coated by means of a wire bar and dried at 140° C. for 1 minute to form an outermost layer with a thickness of 3 μm, thus obtaining a back layer.

Recipe (A-I) for Outermost Layer

| | Solid Content by weight ratio |
|---|---|
| Clay | 58 |
| Acrylic Copolymer | 34 |
| Polyvinyl Alcohol | 9 |
| Melamine Crosslinking Agent | 4.3 |

The above composition was previously dissolved in or dispersed in water to finally yield a whole solid content of 30 weight %.

Recipe (B-1) for Inner Layer

| | Solid Content by weight ratio |
|---|---|
| Clay | 45 |
| SBR Resin (Tg: 0° C.) | 25 |
| Melamine Crosslinking Agent | 3.3 |

The above composition was previously dissolved in or dispersed in water to finally yield a whole solid content of 30 weight %.

Onto a surface of a base were coated a 5% aqueous solution of PVA to obtain a film thickness, on dry basis, of 8 μm by a wire bar, then coated the following composition, as a photoconductive layer, Composition of Photoconductive Layer

| | weight part |
|---|---|
| Photoconductive Zinc Oxide (commercial name, SAZEX 2000) | 100 |
| Acrylic Resin (made by Fuji Photo Film Co.) | 20 |
| Rose Bengal | 0.1 |
| Toluene | 190 |

and dried to form a photoconductive layer with a coating amount, on dry basis, of 23 g/m$^2$, thus obtaining an electrophotographic printing plate precursor.

When each layer of the back layers in the resulting electrophotographic printing plate precursor was subjected to measurement of the water absorbing capacity using a Cobb's water absorbing meter, the outermost layer showed a water absorbing capacity of 75 g/m$^2$ and the inner layer showed that of 11 g/m$^2$.

The two precursors (samples) were superimposed upward, on which a metallic piece of aluminum with a bottom area of 5 cm$^2$ and weight of 20 g was placed, and only the lower sample was forcedly slid while fixing the upper sample not to move, thus forcedly rubbing them. Then, the drawn lower sample was subjected to, as a precursor, plate making using an electrophotographic plate making machine ELP-3100 (-commercial name-made by Fuji Photo Film Co.), to etching of the surface thereof with a cotton piece moistened with an etching solution E 2 (-commercial name- made by Fuji Photo Film Co.) and to printing using a printing machine of Ryobi AD 80 Type (-commercial name- made by Ryobi KK), and the number of prints was examined until printing scum by rubbing and printing wrinkles occurred. The results are shown in Table 1, from which it is apparent that wrinkles and printing scum by rubbing do not appear until printing 1500 prints.

COMPARATIVE EXAMPLE 1

Example 1 was repeated except using the following recipe (A-2) for the outermost layer of the back layers, containing no hydrophilic high molecular material, to prepare a lithographic printing plate precursor, during which the water absorbing capacity of the outermost layer was 23 g/m$^2$ and that of the inner layer was 11 g/m$^2$.

Recipe (A-2) for Outermost Layer

| | Solid Content by weight ratio |
|---|---|
| Clay | 58 |
| Polyacrylic Acid Ester | 43 |
| Melamine Crosslinking Agent | 4.3 |

The above composition was previously dissolved in or dispersed in water to finally yield a whole solid content of 30 weight %.

Recipe (B-i) for Inner Layer

When the resulting precursor was subjected to estimation of printing in an analogous manner to Example 1, 1550 prints could be printed until wrinkles appeared, as shown in Table 1, but printing scum by rubbing had appeared.

COMPARATIVE EXAMPLE 2

Example 1 was repeated except using the following recipe (B-2) having a high water absorbing capacity for the inner layer of the back layers to prepare a lithographic printing plate precursor, during which the water absorbing capacity of the outermost layer was 75 g/m$^2$ and that of the inner layer was 45 g/m$^2$.

Recipe (A-1) for Outermost Layer

Recipe (B-2) for Inner Layer

| | Solid Content by weight ratio |
|---|---|
| Clay | 45 |
| SBR Resin (Tg: 0° C.) | 20 |
| Polyvinyl Alcohol | 5.0 |
| Melamine Crosslinking Agent | 3.3 |

The above composition was previously dissolved in or dispersed in water to finally yield a whole solid content of 30 weight %.

When the resulting precursor was subjected to estimation of printing in an analogous manner to Example 1, no printing scum occurred, but printing wrinkles appeared by 350 prints, as shown in Table 1.

COMPARATIVE EXAMPLE 3

Example 1 was repeated except that a similar base to Example 1 was coated as a back layer, with a composition prepared by mixing Recipe (A-1) and Recipe (B-1) as shown in the following Recipe (C-1) and drying at a temperature of 135° C. for 1 minute to form a single back layer having a thickness of 10 μm and a water absorbing capacity of 40 g/m$^2$, thus obtaining a lithographic printing plate precursor.

Recipe (C-1) for Back Layer of Single Layer

| | Solid Content by weight ratio |
|---|---|
| Clay | 103 |
| Acrylic Copolymer | 34 |
| SBR Resin (Tg: 0° C.) | 25 |
| Polyvinyl Alcohol | 9 |
| Melamine Crosslinking Agent | 7.6 |

The above composition was previously dissolved in or dispersed in water to finally yield a whole solid content of 30 weight %.

When the resulting precursor was subjected to estimation of printing in an analogous manner to Example 1, printing scum occurred to a slight degree, but 450 prints were obtained until printing wrinkles occurred.

EXAMPLE 2

Example 1 was repeated except adjusting the thickness of the outermost layer to 5 μm on dry basis (water absorbing capacity: 70 g/m$^2$) and that of the inner layer to 5 μm on dry basis (water absorbing capacity: 20 g/m$^2$) to prepare an electrophotographic lithographic printing plate precursor of the present invention.

Recipe (A-1) for Outermost Layer

Recipe (B-1) for Inner Layer

When the resulting precursor was subjected to estimation of printing in an analogous manner to Example 1, 1400 prints could be printed until wrinkles appeared, as shown in Table 1, but printing scum by rubbing had appeared.

COMPARATIVE EXAMPLE 4

Example 1 was repeated except adjusting the thickness of the outermost layer to 6 μm on dry basis (water absorbing capacity: 65 g/m$^2$) and that of the inner layer to 4 μm on dry basis (water absorbing capacity: 30 g/m$^2$) to prepare an electrophotographic lithographic printing plate precursor.

Recipe (A-1) for Outermost Layer

Recipe (B-1) for Inner Layer

When the resulting precursor was subjected to estimation of printing in an analogous manner to Example 1, no printing scum occurred, but printing wrinkles occurred by 420 prints.

TABLE 1

| Example | Recipes for Outermost Layer and Inner Layer | Thickness on Dry Basis (μm) | Water Absorb-Capacity (g/m$^2$) | Printing Scum by Rubbing | Number of Prints until Printing Wrinkles |
|---|---|---|---|---|---|
| Example 1 | (A-1) | 3 | 75 | ○ | at least 1500 |
| | (B-1) | 7 | 11 | | |
| Comparison 1 | (A-2) | 3 | 23 | X | at least 1550 |
| | (B-1) | 7 | 11 | | |
| Comparison 2 | (A-1) | 3 | 75 | ○ | 350 |
| | (B-2) | 7 | 45 | | |
| Comparison 3 | (C-1) | 10 | 40 | Δ○ | 450 |
| Example 2 | (A-1) | 5 | 70 | ○ | 1400 |
| | (B-1) | 5 | 20 | | |
| Comparison 4 | (A-1) | 6 | 65 | ○ | 420 |
| | (B-1) | 4 | 30 | | |

(Note) Estimation Standard
○: no printing scum by rubbing
Δ: littl printing scum by rubbing
X: occurrence of printing scum by rubbing

EXAMPLES 3 TO 5 AND COMPARATIVE EXAMPLE 5

The outermost ayer of the back layers was formed of each of the following recipes (A-3) and (A-4) and the inner layer of the back layers was formed of the following recipe (B-3) to prepare each of electrophotographic lithographic printing plate precursors in an analogous manner to Examples 1 and 2 and Comparative Examples 1 to 4. In these Examples, Dentol WK-100 W/(-commercial namemde by Otsuka Kagaku KK) was used as an electrically conductive fine powder. The layer thickness, on dry basis, of each layer and the water absorbing capacity were as shown in Table 2.

Recipe (A-3) for Outermost Layer

| | Solid Content by weight ratio |
|---|---|
| Clay | 58 |
| Electrically Conductive Fine Powder | 14 |
| Polyacrylic Acid Ester | 34 (emulsion) |

-continued

| | Solid Content by weight ratio |
|---|---|
| Starch | 9 |
| Melamine Crosslinking Agent | 4.3 |

The above composition was previously dissolved in or dispersed in water to finally yield a whole solid content of 30 weight %.

Recipe (B-3) for Inner Layer

| | Solid Content by weight ratio |
|---|---|
| Clay | 45 |
| SBR (Tg: 30° C.) | 25 (emulsion) |
| Melamine Crosslinking Agent | 3.3 |

The above composition was previously dissolved in or dispersed in water to finally yield a whole solid content of 30 weight %.

Recipe (A-4) for Outermost Layer

| | Solid Content by weight ratio |
|---|---|
| Clay | 58 |
| Electrically Conductive Fine Powder | 14 |
| Polyacrylic Acid | 43 (emulsion) |
| Melamine Crosslinking Agent | 4.3 |

The above composition was previously dissolved in or dispersed in water to finally yield a whole solid content of 30 weight %.

The thus obtained electrophotographic lithographic printing plate precursors of Examples 3 to 5 and Comparative Example 5 were estimated in an analogous manner to Example 1 to obtain results as shown in Table 2.

TABLE 2

| Example | Recipes for Outermost Layer and Inner Layer | Thickness on Dry Basis (μm) | Water Absorb-Capacity (g/m²) | Printing Scum by Rubbing | Number of Prints until Printing Wrinkles |
|---|---|---|---|---|---|
| Example 3 | (A-3) | 3 | 75 | ○ | at least 1500 |
| | (B-3) | 7 | 20 | | |
| Comparison 5 | (A-4) | 3 | 20 | X | at least 1550 |
| | (B-3) | 7 | 20 | | |
| Example 4 | (A-3) | 5 | 70 | ○ | 1300 |
| | (B-3) | 5 | 30 | | |
| Example 5 | (A-3) | 6 | 65 | ○ | 380 |
| | (B-3) | 4 | 35 | | |

(Note) Estimation Standard
○: no printing scum by rubbing
Δ: littl printing scum by rubbing
X: occurrence of printing scum by rubbing It will clearly be understood from the above described Examples and Comparative Examples that the opposite effects of preventing occurrence of printing scum by rubbing and increasing the number of prints until occurrence of printing wrinkles (improvement of water resistance) can simultaneously be satisfied with compatibility by forming a back layer of a plurality of layers, incorporating a hydrophilic high molecular material in the outermost layer thereof and adjusting the Cobb's water absorbing capacity of the inner layer to at most 25 g/m² (45 minute value).

Utility and Possibility on Commercial Scale

As illustrated above, according to the present invention, there can be provided an electrophotographic lithographic printing plate precursor wihtout printing scum by rubbing during production thereof, which is capable of printing a number of prints without occurrence of wrinkles during printing. The precursor of the present invention can be applied to development by not only the ordinary electrophotographic method, but also the direct electron injection system.

What is claimed is:

1. An electrophotographic lithographic printing plate precursor comprising, at least, a photoconductive layer on one surface of a base and a back layer on the other surface thereof, in which the back layer comprises an outermost layer containing a hydrophilic high molecular material and an inner layer having a Cobb's water absorbing capacity of at most 25 g/m² (45 minute value).

2. The electrophotographic lithographic printing plate precursor as claimed in claim 1, wherein the outermost layer contains a hydrophilic colloid.

3. The electrophotographic lithographic printing plate precursor as claimed in claim 1, wherein the inner layer consists of a plurality of layers.

4. The electrophotographic lithographic printing plate precursor as claimed in claim 1, wherein at least one layer of the outermost layer and the inner layer contains a hydrophilic high molecular material binder.

5. The electrophotographic lithographic printing plate precursor as claimed in claim 1, wherein the hydrophilic high molecular material contained in the outermost layer is at least one member selected from the group consisting of gelatins, celluloses, water-soluble derivatives of starch, polyvinyl alcohol, polyvinyl pyrrolidone, polyacrylamide and styrene-maleic anhydride copolymers.

6. The electrophotographic lithographic printing plate precursor as claimed in claim 1, wherein the outermost layer is formed of at least one member selected from the group consisting of water-resisting film forming materials, water-resisting and organic solvent-resisting materials and synthetic emulsions.

7. The electrophotographic lithographic printing plate precursor as claimed in claim 1, wherein the hydrophilic high molecular material is present in a proportion of 3 to 40% by weight.

8. The electrophotographic lithographic printing plate precursor as claimed in claim 1, wherein the inner layer is formed of at least one member selected from the group consisting of water-resisting film forming materials, water-resisting and organic solvent-resisting materials, synthetic emulsions and hydrophilic high molecular materials.

9. The electrophotographic lithographic printing plate precurser as claimed in claim 1, wherein the outermost layer has a thickness of 0.5 to 10 μm.

10. The electrophotographic lithographic printing plate precurser as claimed in claim 1, wherein the inner layer has a thickness of 2 to 25 μm.

11. The electrophotographic lithographic printing plate precursor as claimed in claim 1, wherein the back layer has a thickness of 3 to 25 μm.

* * * * *